US005522755A

United States Patent [19]

Farrell et al.

[11] Patent Number: 5,522,755

[45] Date of Patent: Jun. 4, 1996

[54] SUPERCOMPRESSED SPONGE INTERACTIVE TOY

[76] Inventors: Dennis A. Farrell, 33 Hollow Oak Rd., Chappaqua, N.Y. 10514; Gregory E. Hyman, 377 Cross Pond Rd. Rte. 2, Pound Ridge, N.Y. 10576

[21] Appl. No.: 816,991

[22] Filed: Jan. 6, 1992

[51] Int. Cl.[6] ..... A63H 23/00

[52] U.S. Cl. ..... 446/153; 446/268

[58] Field of Search ..... 446/69, 153, 156, 446/267, 486, 268

[56] References Cited

U.S. PATENT DOCUMENTS

| | | | |
|---|---|---|---|
| 2,760,302 | 8/1956 | Cheskin | 446/153 X |
| 2,952,462 | 9/1960 | Planin | 446/153 X |
| 4,529,569 | 7/1985 | Palau | 446/153 X |
| 4,881,915 | 11/1989 | Liaw | 446/153 |

*Primary Examiner*—Sam Rimell
*Attorney, Agent, or Firm*—Carl C. Kling

[57] ABSTRACT

An interactive toy in which a supercompressed sponge novelty item in an internal chamber expands or pops open a pop-open door when significant water is intoduced into the chamber. There is a water receiving device for water entry, which is connected to the interanl chamber so as to trigger a surprise expansion of the supercompressed sponge novelty items in the chamber. The supercompressed sponge novelty item, or plurality of novelty items positioned together or separately, expand to interesting size or pop open the door when the expansion becomes sufficient. The interactive toy may be in various forms, including a cookstove embodiment with expandible food novelty items including bread, rolls, cake, etc. or nonexpandible items such as a roast. Another form may be a guts-gushing monster with a belly chamber full of expandible entrail novelty items. Another form is a race car. Water may be introduced into the chamber by, for example, an eyedropper "baster" for the novelty items in the oven of the cookstove and, for example, a squirt gun for the entrail novelty items in the belly of the guts-gushing monster. Water-activated dry aromatics may be added during manufacture or by the player so as to cause cooking odors or stench.

16 Claims, 2 Drawing Sheets

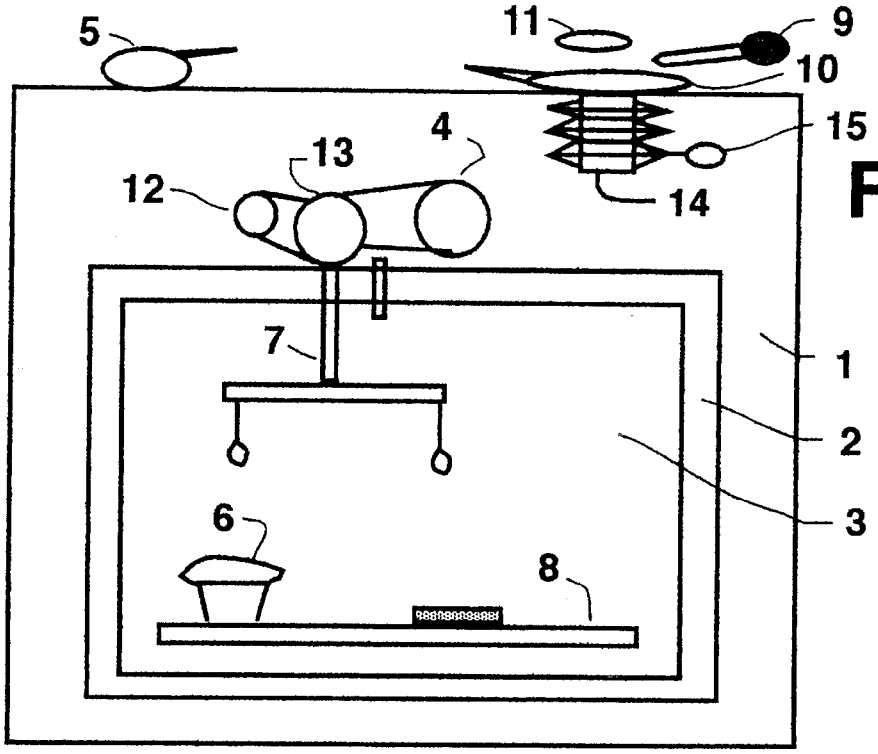
Fig. 1
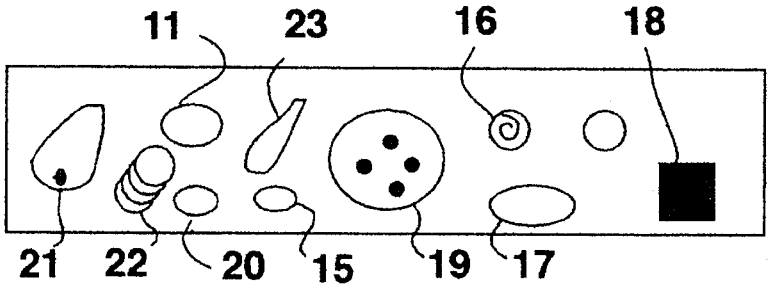
Fig. 2
Fig. 6
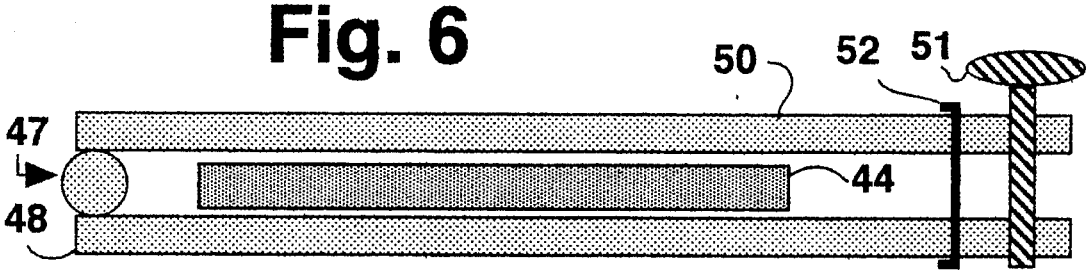

SUPERCOMPRESSED SPONGE INTERACTIVE TOY

BACKGROUND OF THE INVENTION

1. Field of the Invention

This invention relates to interactive toys, and particularly relates to a toy using a supercompressed sponge novelty item as the reaction element responsive to a water adding action by the player to trigger a surprise expansion of the supercompressed sponge novelty item.

2. Description of Related Art

Supercompressed sponges are known. A thin supercompressed sponge wafer becomes an ordinary cellulose sponge when wetted. Jack-in-the-box toys are well known, in which a loosely-timed surprise pop-up occurs. One of the coinventors of this supercompressed sponge interaction toy has previously filed a United States patent application for a novelty soap item with an internally captured supercompressed sponge novelty item which pops up like a jack-in-the-box as the soap covering is removed by use. See U.S. patent application of Dennis Farrell, Ser. No. 07/687,275, SPONGE-TOY SOAP, filed Apr. 19, 1991.

SUMMARY OF THE INVENTION

It is the object of the invention to provide an interactive toy with an internal novelty item which expands as a result of a water-adding event resulting from action by the player.

A feature of the invention is a supercompressed sponge novelty item, placed within the toy so as to expand or to pop out unexpectedly in response to action by the player, which action by the player causes water to contact an internally placed supercompressed sponge novely item.

Another feature of the invention is a water-activated aromatic additive by which aromas add realism and interest to the activity.

Advantages of the invention are its elegant simplicity, its paucity of moving parts, and its educational value coupled with its fun value.

Another advantage is its relative ease of manufacture including its packaging, the novelty items of supercompressed sponge being packaged within the device.

Another advantage of the invention is its appeal to the young child who may be in charge of a safe fun activity which has as a side effect a scientific study of grown-up activity patterns.

Another advantage of the invention is its reversibility, which permits it to be used over and over again through the simple expedient of recompressing the expanded novelty items.

Other objects, features and advantages of the invention will be apparent from the following specification and from the annexed drawings and claims.

BRIEF DESCRIPTION OF THE DRAWINGS

FIG. 1 is an semidiagrammatic view of a cookstove embodiment of the invention, in which the supercompressed sponge novelty items (bread loaves shown) are in the act of rising as they "cook" by expanding as water is brought into contact.

FIG. 2 is a diagram of a wafer of partially cut out food items for cooking in the cookstove embodiment.

FIG. 6 is a side elevation view of a sponge recompressor for use in returning sponge novelty items to their supercompressed condition for storage or reuse.

DETAILED DESCRIPTION OF THE PREFERRED EMBODIMENT

Figure 3:
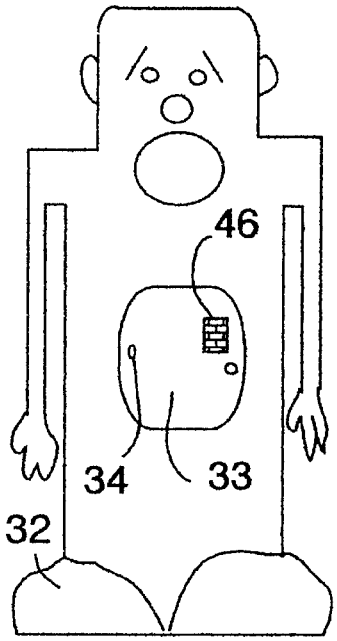
FIG. 3 is a semidiagrammatic view of a guts-gushing monster embodiment with supercompressed sponge novelty items (stomach, lungs, heart, guts, kidneys, liver, etc.) which "explode" from an abdominal door as he is shot in the mouth with a water pistol.

FIG. 1 shows the cookstove 1, with its oven door 2 and oven door window 3. Of course the oven door 2 can be opened and closed by the player. In the preferred embodiment, the cookstove 1 is equipped with at least one oven control 4, and may have a saucepan as water receiving device 5 on its cooktop. The water receiving device 5 accepts water from the player at start of play, or in the most simple embodiment may feed small amounts of water directly without the use of the oven control, by some artifice such as a small hole directly over a cooking position in the oven. The oven control 4, where used, opens a water passageway sufficiently to let water penetrate through to the novelty items (bread loaf 6 shown visible through oven window 3). Water, upon reaching the bread loaf 6 (or other novelty food item) is absorbed by the supercompressed sponge, and causes the bread loaf 6 to expand dramatically.

Water, which has been added via receiving device 5, is allowed to flow or to drip on the supercompressed sponge novelty item such as bread loaf 6. The inset shows a preferred water distribution system, which uses oven control 4 as the controller for duct 7, which allows water to drip onto bread loaf 6 or into a pan 8 in which the supercompressed bread loaf 6 has been placed. The water drips onto or flows up into supercompressed bread loaf 6 and causes it to expand drammatically, to something like ten times its supercompressed size, just as actual bread might rise. The fresh-baked bread is then ready to remove from the oven.

In a less complex embodiment, the water may be dripped directly from the receiving device 5, or even added by the player from an eyedropper 9 which appears properly sized as a baster. Cooktop frying may be accomplished in skillet 10 to which water is added along with the supercompressed sponge novelty item such as pancake 11.

In a more complex embodiment, the water flow may be metered and timed by the oven control mechanism 4, which may include a timer 12 to impede the return by valve 13 to the normally closed position. The timer 12 or untimed oven control 4 opens the valve 13 for the period of time selected by the player to bake the appropriate item. Timer 12 may be any clockwork or other delay mechanism such as a spring return impeded by a pneumatic piston. Valve 13 may be of any type, such as a simple pinch closure on a collapsible tube, or any other fluid cutoff device subject to operation by timer 12. The water distribution plumbing may be as simple as space for inserting an eyedropper or a grate to serve as a target for the aimed product of a squirtgun, or may include tubing as plumbing, with simple or complex controls such as timers and valves. Such water distributing means may be generally characterized as whatever is required to give applied liquid access to a supercompressed sponge in whatever amount is necessary to expand such supercompressed sponge.

FIG. 2 shows partially cut out novelty food items printed and perforated upon a supercompressed sponge wafer. The novelty food items can include bread loaf 6, pancake 11, biscuit 15, pastry roll 16, cake 17, brownie 18, pizza 19 and cookie 20, all of which normally rise or swell during baking—and can also include other novelty food items such as ham 21, roast beef 22, and turkey drumstick 23. In use, the player (normally a child) selects the food item, puts it in pan 8 and preheats the oven. The preheating step, as in grown-up cooking, may not always be necessary, but it is a helpful step in that it primes the water delivery mechanism. The child then places the pan with the selected food item into the oven, and sets the timer. The timer then meters the drip or flow of water so as to deliver the appropriate dose of water for the selected food item—much as grown-up baking takes longer for a loaf of bread than for a biscuit. The water delivery mechanism thus may simulate both temperature control and time.

The food novelty item need not be precisely placed within the oven, provided that the novelty food item is placed properly with respect to water drip or water pan 8. The water metering means may be as simple as baster 9 or as complex as timer 12 and valve 13, which may be a simple open/closed valve or a flow-metering valve.

The entire apparatus of cookstove 1 is preferably of plastic. The supercompressed sponge novelty items are preferably made of cellulose sponge material.

Multiple novelty items of supercompressed sponge may be included, to "bake" together. Care must be taken not to overload the oven, or there may be a cartoon-like disaster in which the food swells up so much that it pops open the oven door and falls out of the oven.

Cooking aromas are available in ponder form and may be added like salt and pepper to the supercompressed sponge novelty items, or may be added during manufacture to the supercompressed sponge. The dry aromatic preferably is one which releases its fragrance upon contact with water. Some available aromas are: charcoal, pizza cheese, bread, and various spices. Another available aroma is: stench.

Figure 4:
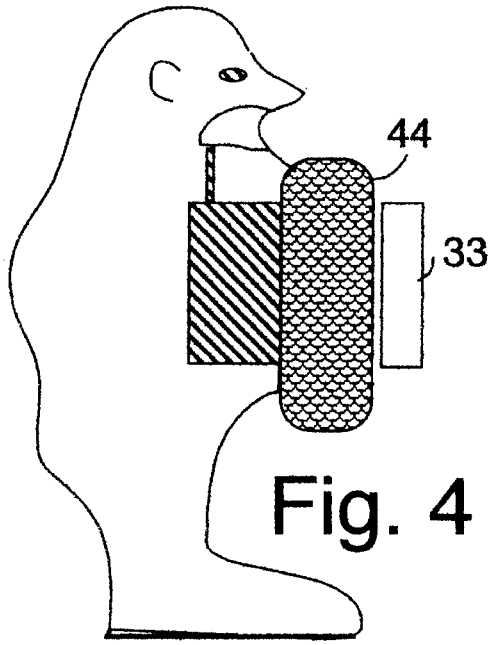
FIG. 4 is a diagram of partially cut out entrails for the guts-gushing monster embodiment.

FIGS. 3 and 4 show a guts-gushing monster embodiment. Guts-gushing monster 31 is a grotesque but quasi-human monster with huge feet 32 for stability and with a belly door 33 having a pins 34 which pops open under pressure. Guts-gushing monster 31 has a large mouth opening which serves as primary water receiver 35. Guts-gushing monster entrails 36 include heart 37, liver 38, lungs 39, kidneys 40, stomach 41 and both small intestine 42 and large intestine 43.

Figure 5:
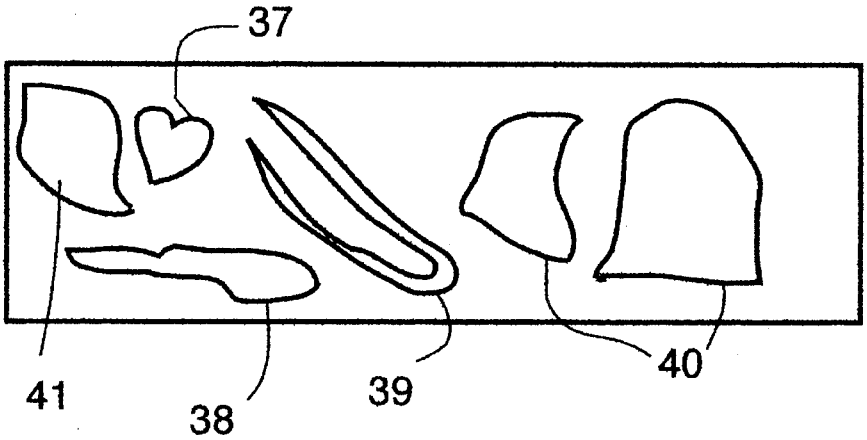
FIG. 5 is a diagram similar to that of FIG. 4, but in which the novelty items are merely depicted by preprinting upon a single block of supercompressed sponge, rather than being partially pre-cut.
Figure 7:
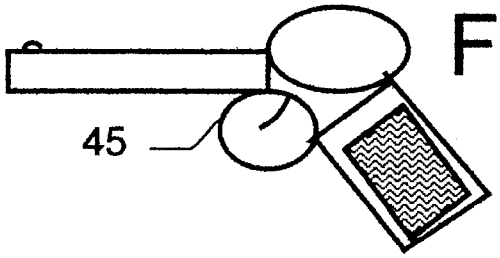

FIG. 5 shows wafer 44 with the entrails 36 painted or printed upon it. The entrails preferably are kept together in the wafer, but may be separated into separate items if the guts-gushing monster is large enough for this to be convenient.

In use, guts-gushing monster 31 is loaded with a dry supercompressed sponge wafer 44 of entrails 36 and has his belly door 33 closed and held by pins 34. The guts-gushing monster 31 then stands on his huge feet 32 (or upon an equivalent platform) with his mouth agape as water receiver 35.

FIG. 6 shows a squirt gun as a water metering device. The player, armed with squirt gun 45, squirts water into the mouth opening 35 of the guts-gushing monster 31 (FIG. 3). As water is collected in water receiver 35, which has connection to the belly cavity in which the dry entrails 36 are captured, the water soaks into the dry entrails 36. In reaction to the action of squirting water into the mouth opening 35 by the player, the entrails 36 begin to expand. As more water is delivered by a lucky shot or by a series of shots, the entrails 36 swell up more and more, until finally they pop open the belly door 33 (see FIG. 4) whereupon entrails 36 spill out. Belly door 33 may be equipped with a grating target 46 to serve as a secondary water receiver, a slightly more difficult shot with a water pistol.

As explained above with respect to the cookstove embodiment, aroma-forming dry powder may be added to the supercompressed sponge novelty item, the guts. The most likely choice for this addition is: stench.

Another form of the invention is a race car or other automotive vehicle normally having an engine in an engine compartment. The supercompressed sponge novelty item is configured as an engine, and placed in an engine compartment. If the vehicle is driven in such fashion that water enters the engine compartment, the engine will blow and cause the hood to pop up or off, and the engine will fall out.

FIG. 6 shows sponge supercompressor 47, which is a simple set of hinged plastic plates 48–49 with capillary holes 50 to allow water and flow. There is a handscrew 51 to compress the supercompressor 47 with the novelty item between its plates; latch 52 holds supercompressor 47 shut for the drying time and storage time after the handscrew 51 has been removed. This permits the handscrew to be removed for easier storage of the supercompressor as a flat item.

The player takes the wet expanded food novelty items or expanded entrails 36 and places them onto the supercompressor and steps onto the supercompressor to flatten the expanded novelty food items or expanded entrails to remove the water and return them to supercompressed dimensions. The latch allows the supercompressor to hold the supercompressed novelty items for several hours until they dry, whereupon they will hold their supercompressed dimensions. If the novelty items are removed from the supercompressor while still wet, they tend to expand to their wet dimensions, which diminishes the fun.

The guts-gushing monster appeals to the child's appetite for forbidden slimy things, while at the same time giving a chance to watch reaction to his or her action, and at the same time to learn about internal organs. The cookstove at first glance appears to be a much tamer toy, but it too can be a learning experience involving action in timing the cooking and watching the results with various food items. Of course, children seem able to invent their own actions and reactions. In both cases, these toys have the advantage of being almost forbidden, in that they permit the child to mess with water. The small amounts of water involved, however, do not cause significant problems on waterproof floors or pads.

While the invention has been shown preferably in the form of three devices, cookstove, vehicle, and guts-gushing monster, each with a set of related supercompressed sponge novelty items, it will be clear to those skilled in the art that the modifications described as alternatives, plus other alternatives, may be pursued without departing from the spirit and scope of the invention, as defined in the following claims:

What is claimed is:

1. An interactive toy comprising:

a) a main body with a receptacle encompassing a set of at least one supercompressed sponge novelty item and having a liquid source station integral with said main body; and b) liquid distributing means interconnecting such liquid source station integral with said main body in a manner permitting liquid applied at such source station to contact said set of at least one supercompressed sponge novelty item whereby liquid supplied at such liquid source station expands said set of at least one supercompressed sponge novelty item to a selected level of expansion.

2. An interactive toy according to claim 1, in which said set of supercompressed sponge novelty items is subjected to the timed application of water in controlled amounts via said water distributing means.

3. An interactive toy according to claim 1, in which one or more sets of supercompressed sponge novelty items are precut in a single supercompressed sponge wafer.

4. An interactive toy according to claim 1, in which said toy is a simulated monster having a belly door and belly cavity into which a set of at least one supercompressed sponge novelty item, such as simulated guts, may be placed, and said water distributing means comprises an opening with a screen in said belly door, whereby liquid applied through said screen into said belly cavity expands such set of supercompressed sponge novelty items sufficient to power such belly door suddenly open.

5. An interacting toy according to claim 4, in which said belly door is equipped with latches to enable pop-out of belly cavity content self-powered by expansion of such belly cavity content upon introduction of liquid.

6. An interactive toy according to claim 4, in which said toy main body has an internal cavity into which water may be introduced, said internal cavity being equipped with a pop-open door, said internal cavity and pop-open door being so related that a selected supercompressed sponge novelty item when dry may be comfortably contained within said internal cavity but upon introduction of water into said internal cavity from said water distributing means, said supercompressed sponge novelty item expands so as to push open said pop-open door and spill the expanded, formerly supercompressed sponge novelty item.

7. An interactive toy according to claim 6, in which said toy is a guts-gushing monster having an internal cavity into which water may be introduced by player action, said internal cavity being equipped with a pop-open belly door, said internal cavity and pop-open belly door being so related that a selected supercompressed sponge novelty item when dry may be comfortably contained within said internal cavity but upon introduction of water into said internal cavity from said water distributing means, said supercompressed sponge novelty item expands so as to push open said pop-open belly door and spill the expanded, formerly supercompressed sponge novelty item.

8. An interactive toy according to claim 6, in which said toy is an automotive vehicle of the type having an engine, said internal cavity is an engine compartment, and said supercompressed sponge novelty item is configured as an engine.

9. An interactive toy according to claim 1, comprising in addition a water-activated aromatic additive for said supercompressed sponge novelty item, such aroma being related to the configuration of the respectively related novelty item.

10. An interactive toy comprising:

a) a main body with a receptacle encompassing a set of at least one supercompressed sponge novelty items and having a liquid source station with said main body; and b) liquid distributing means interconnecting such liquid source station integral with said main body in a manner permitting liquid applied at such source station to contact said set of supercompressed sponge novelty item whereby liquid supplied in controlled amounts at such liquid source station is calculated to expand said set of supercompressed sponge novelty items to a selected level of expansion.

11. An interactive toy according to claim 10, in which the toy is a cookstove simulation having an oven and said water distributing means comprises a pan-shaped device at the top of the cookstove simulation having an oven, with connection to the oven of said cookstove simulation having an oven.

12. An interactive toy according to claim 11, in which the toy is a cookstove simulation and said water distributing means comprises timer means and valve means.

13. An interactive toy according to claim 12, in which the toy is a cookstove simulation and said water distributing means valve means is a flow-metering valve.

14. An interactive toy according to claim 10, in which the toy is a cookstove simulation and said water receiving means is an eyedropper appropriately sized as a baster for the cookstove simulation.

15. An interactive toy according to claim 10, in which said toy is a simulated monster main body and said water distributing means is a gaping mouth opening connecting to said receptacle which is a belly cavity with a belly door.

16. An interactive toy comprising:

a) a main body with a receptacle encompassing a set of one supercompressed sponge novelty item and having a liquid source station associated with said main body;

b) liquid distributing means interconnecting such liquid source station associated with said main body in a manner permitting liquid applied at such source station to contact said set of supercompressed sponge novelty items whereby liquid supplied in controlled amounts at such liquid source station is calculated to expand said set of supercompressed sponge novelty items to a selected level of expansion; and c) one or more sets of supercompressed sponge novelty items in a single supercompressed sponge wafer with novelty items pre-cut to selected configurations for easy breakout of individual configured novelty items.

* * * * *